United States Patent [19]

Gratzmuller

[11] Patent Number: 5,031,504

[45] Date of Patent: Jul. 16, 1991

[54] HYDRAULIC JACK WITH A SYSTEM FOR CHECKING THE POSITION OF THE PISTON

[76] Inventor: Claude A. Gratzmuller, 30, avenue Georges Mandel, 75116 Paris, France

[21] Appl. No.: 420,660

[22] Filed: Oct. 11, 1989

Related U.S. Application Data

[63] Continuation of Ser. No. 188,460, Apr. 29, 1988, abandoned.

[30] Foreign Application Priority Data

May 6, 1987 [FR] France ..... 87 06368

[51] Int. Cl.[5] ..... F01B 25/26; F01B 31/12

[52] U.S. Cl. ..... 91/1; 200/82 E; 92/5 R; 92/162 R; 324/207.15

[58] Field of Search ..... 91/1, 417 R, 361, 362, 91/363 R, 364; 92/5 R; 200/82 E; 60/390; 324/207.15

[56] References Cited

U.S. PATENT DOCUMENTS

| | | | |
|---|---|---|---|
| 4,026,523 | 5/1977 | Gratzmuller | 91/396 X |
| 4,316,145 | 2/1982 | Tann | 324/208 |
| 4,385,297 | 5/1983 | Schmitt et al. | 324/208 X |
| 4,592,249 | 6/1986 | Lehmann et al. | 324/208 X |
| 4,681,992 | 7/1987 | Kazmierski | 200/82 E |
| 4,736,674 | 4/1988 | Stoll | 92/5 R |
| 4,755,636 | 7/1988 | Akio | 200/82 E |
| 4,756,229 | 7/1988 | Drakeley | 91/361 X |

*Primary Examiner*—Edward K. Look
*Assistant Examiner*—Thomas Denion
*Attorney, Agent, or Firm*—Max Fogiel

[57] ABSTRACT

In order to check the operation of high-voltage electric circuit-breakers, proximity detectors are housed in through-bores pierced in the wall of the hydraulic jack cylinder, the through-bores being disposed in spaced relation over a distance corresponding to the range of travel of the jack piston. Since no provision is made for any piston ring or packing seal, the jack piston is not damaged as it passes against the outlets of the through-bores on the internal surface of the cylinder. The output signals of the proximity detectors are applied to a unit for measuring and controlling the position of the piston within the cylinder.

7 Claims, 2 Drawing Sheets

HYDRAULIC JACK WITH A SYSTEM FOR CHECKING THE POSITION OF THE PISTON

The present application is a continuation of the parent application Ser. No. 188,460 filed Apr. 29, 1988 now abandoned.

BACKGROUND OF THE INVENTION

1. Field of the Invention

The present invention relates to a hydraulic jack with a system for checking the position of the piston.

2. Description of the Prior Art

In many applications of jack-operated hydraulic control systems, it is necessary to determine the position of the element which is actuated by the jack. To this end, it is a customary practice to make use of so-called end-of-travel contacts or passing contacts which are influenced by the element itself or by an associated element such as, for example, the emergent rod of the piston.

However, for certain specific applications such as, for example, hydraulic control of high-voltage electric circuit-breakers, it is highly inconvenient and often impossible (on account of the voltage applied to certain moving parts) to install end-of-travel detectors or the like in immediate proximity to elements which are actuated by the jack.

It is for this reason that, in order to avoid mechanical connections of substantial length and low reliability, provision is made in electric circuit-breaker control systems for a so-called "image jack" or in other words a small auxiliary control jack which is supplied or connected to drain in the same manner as the main jack. Thus the auxiliary jack is intended to reproduce the operations of the main jack and consequently to reproduce the displacements of the element actuated by said jack, namely the moving contact of the circuit-breaker.

Aside from its principal function which consists in indicating the open or closed position of the circuit-breaker, the "image jack" also has the function of controlling certain automatic safety operations of the circuit-breaker. This jack must therefore offer highly reliable operation, with the result that it is difficult and therefore costly to manufacture with a view to guarding against any danger of a false indication. A further disadvantage of such jack is that it entails the need for an additional hydraulic circuit, which may be a source of leakages of hydraulic fluid.

Furthermore, in modern circuit-breaker control systems, it is a desirable objective to check the real response and operating times of the moving contact of the circuit-breaker under service conditions. It is known that the operating times are of very short duration, namely of the order of a few hundredths of a second. These time intervals are checked at the moment of reception of equipment but it is no longer possible to determine whether initial performances in fact continue to be maintained once this equipment has been put in service. It would also prove highly advantageous to make sure that these operating times are wholly constant and reproducible, in particular in the case of circuit-breakers having a number of poles in series in which operations must be absolutely simultaneous. Finally, electrical engineers take into account the time of outward displacement of the moving contact with respect to the stationary contact (this time interval being clearly only a fraction of the total time of displacement of the moving contact) and also need to determine the curves of velocities of the moving contact.

It will be readily apparent that, since the inertia of the "image jack" is not at all the same as that of the main jack and the moving parts which it actuates, said "image jack" is not capable of giving any useful indication in regard to the different operating characteristics under service conditions.

The object of the present invention is to overcome the disadvantages and shortcomings of the control systems such as "image jacks" in particular which have been in use up to the present time.

The present invention permits the construction of a control system which detects the position of the piston itself during its travel within the jack, position detection being possible not only in the two end-of-travel positions but also in a plurality of intermediate positions.

Up to the present time, it has not been possible to house piston-position sensors within a jack cylinder in immediate proximity to the displacement of the piston. In point of fact, conventional jacks designed for circuit-breaker control systems operate at a very high pressure of the order of 300 to 400 bar, which calls for perfect pressure-tightness of the piston within the cylinder. The piston is fitted with a packing seal of a highly elaborate type which consists in the majority of instances of a so-called "spring-loaded packing" and the internal surface of the cylinder is perfectly ground and lapped so as to guard against either wear or damage of the packing. It is clearly not possible to place one or a number of piston proximity detectors within the thickness of the cylinder wall since the resultant irregularities in the surface of the cylinder would have the effect of destroying the packing.

The present inventor has recently found, however, that it was possible to construct differential jacks, especially for the control of circuit-breakers, in which the piston is not provided with any packing seal or ring and in which the piston actuates or is adapted to carry a sealing valve for closing the main chamber of the jack at the end of travel of the piston. In consequence, the leakage flow which exists around the piston by reason of the fact that this latter is no longer provided with any packing seal is prevented from penetrating into the volume of the cylinder located beneath the piston when this latter has reached the end of its travel.

A differential jack of this type in which the piston is not fitted with any packing seal has been described in U.S. patent application Ser. No. 168,148 filed Mar. 15, 1988 in the name of the same inventor.

The present invention applies to a differential hydraulic jack of this type.

SUMMARY OF THE INVENTION

The invention is directed to a jack of the aforementioned type as distinguished by the fact that provision is made for a plurality of through-bores pierced in the jack cylinder wall in spaced relation over a distance corresponding to the range of travel of the piston, that a displacement detector is placed within each through-bore aforesaid with its detection element directed toward the interior of the cylinder in order to be influenced by the passage of the piston and that sealing means are provided between the detector and the external surface of the cylinder in order to restore integrity of leak-tightness of the cylinder at high pressure.

As a consequence, the surface finish of the internal surface of the cylinder is thus destroyed by the through-bores but this is not objectionable since the piston does not carry any delicate packing seal.

Preference is given to the use of sensors known as proximity detectors and in particular inductive transducers which are influenced by the passage of the metallic piston opposite to the bore in which the sensor is housed. It is of course true that the sensors themselves are subjected to the high pressure (300 to 400 bar) which prevails within the jack cylinder but there are currently in existence certain types of sensor which are designed to operate in high-pressure environments such as 500 bar, for example.

An inductive transducer has an incorporated electric switch for delivering on the output cables an analog output signal which can be amplified and processed before being applied to control instruments which indicate the position of the piston within the jack and consequently the position of the actuated element, especially the moving contact of a circuit-breaker.

DETAILED DESCRIPTION OF THE INVENTION

Figure 1:
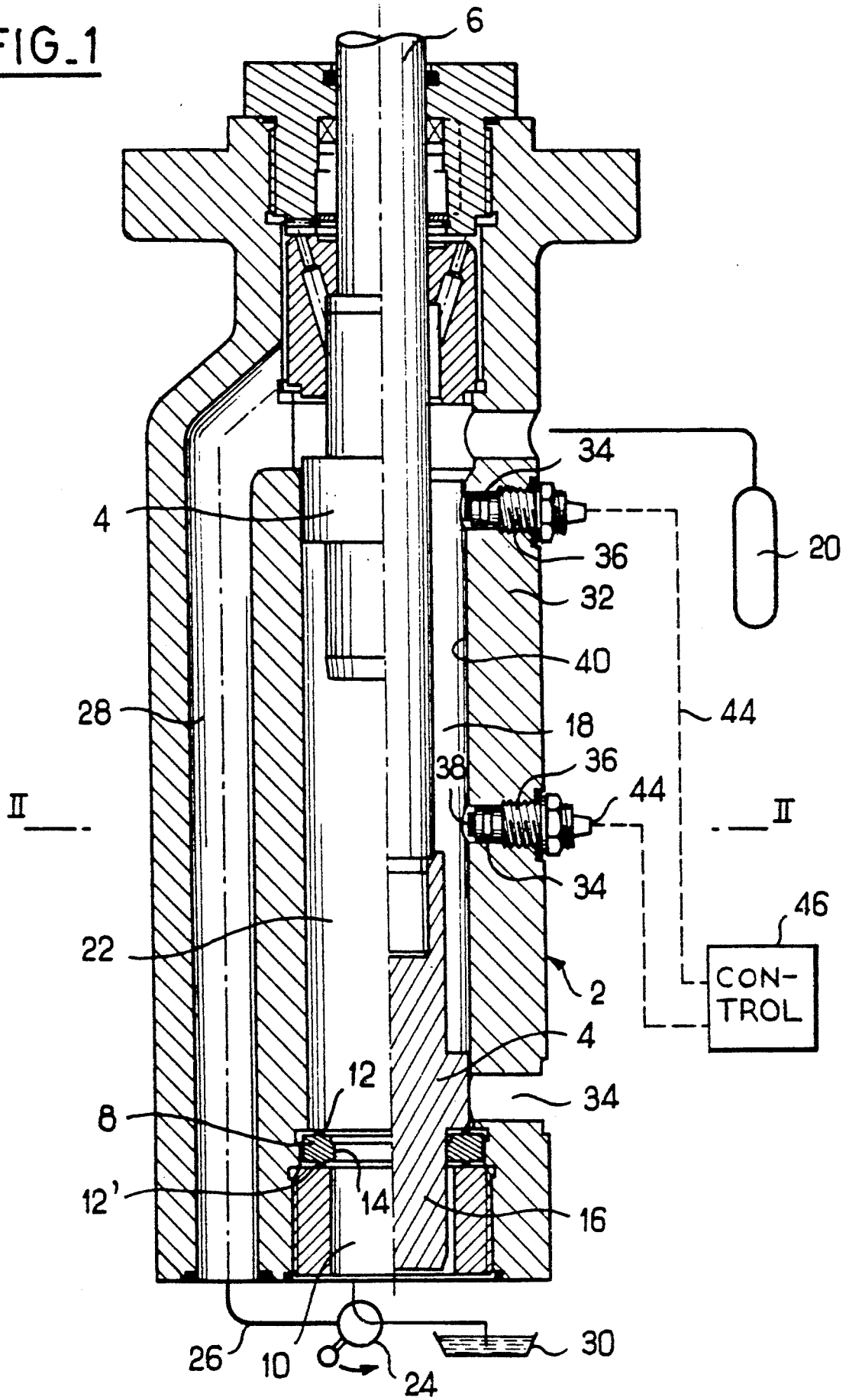
FIG. 1 is an axial view of a differential hydraulic jack in accordance with the invention.

The jack shown in FIG. 1 is of the type described in the patent Application cited earlier and comprises a cylinder 2 which is preferably designed in the form of a casting, a piston 4 which is not provided with any packing seal or ring, a piston rod 6 which is coupled with the moving contact of a circuit-breaker (not shown) and a valve device 8 for closing the admission/discharge orifice 10 of the jack in the bottom end-of-travel position of the piston 4 (this position being shown in the right half of the figure).

In the embodiment illustrated, the jack is also provided with an end-of-travel damping system in which the closure valve consists of a floating ring 8 having two sealing lips 12—12' and having a central bore 14 in cooperating relation with a damping extension stud 16 carried by the piston 6. A damping system of this type together with a floating ring which forms at the same time a closure valve providing a double seal at the end of travel of the piston have been disclosed in U.S. Pat. No. 4,807,514 issued to the same inventor.

As is already known in hydraulic circuit-breaker control systems of the differential jack type, the annular chamber 18 of the jack (above the piston 6) is continuously connected to the high-pressure source constituted by an oleopneumatic accumulator 20. The main chamber 22 of the jack (beneath the piston 6) is selectively connected by means of a three-way valve 24 either to the high pressure (via the line 26 and via a transfer duct 28 which is preferably cast in one piece with the jack cylinder 2) or to discharge to a low-pressure tank 30. This hydraulic circuit-breaker control system of the differential jack type has been described for example in French patent No. 2,317,532 (or U.S. Pat. No. 4,026,523).

In accordance with the invention, provision is made for a plurality of through-bores 34 pierced in the wall 32 of the cylinder 2 at a number of levels along the range of travel of the piston. In the embodiment of FIG. 1, only three through-bores are shown, namely one at each end of the piston and one intermediate through-bore. However, it will be understood that, should it be found necessary to have a larger number of points of detection of the position of passage of the piston, more than three through-bores may accordingly be pierced on one and the same generator-line of the cylinder or preferably on different generator-lines.

Figure 2:
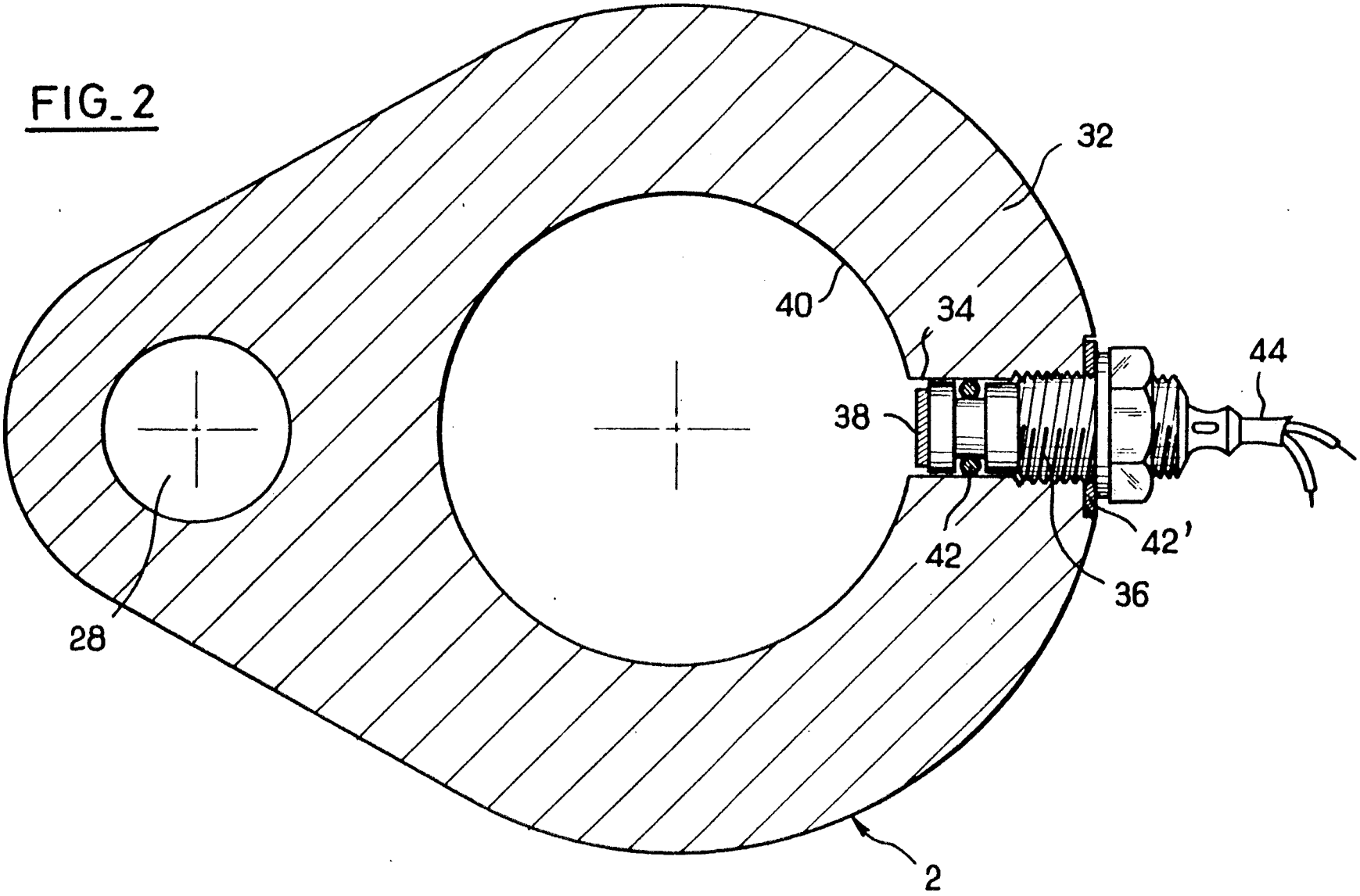
FIG. 2 is a view in transverse cross-section taken along the plane II—II of FIG. 1 and drawn to a larger scale.

A proximity detector 36 is fitted within each through-bore 34. As shown in FIG. 2, the detection face 38 of said detector is flush with the internal surface 40 of the cylinder 2. Sealing means such as seals 42—42' ensure pressure-tight closure of the through-bores 34 under the high pressure which prevails within the jack cylinder after positioning of the detectors 36 within their housings.

For the sake of enhanced clarity of the drawing, there are shown in FIG. 1 only two through-bores 34 fitted with their detectors 36, the mode of assembly of a detector within its housing being shown in greater detail in the sectional view of FIG. 2.

The electrical output of each detector is delivered by means of a twin-lead cable 44; all these cables arrive at means 46 for control and/or recording and/or display of the displacements of the piston 6 as well as the velocity curves if necessary.

As shown in particular in FIG. 2, the through-bores 34 have their openings in the internal surface 40 of the jack cylinder 2, thus having the effect of impairing the integrity of this surface. However, in view of the fact that the piston 6 is not provided with any packing seal or ring applied in leak-tight manner against the internal surface of the cylinder, the non-continuity of this surface does not represent any disadvantage. On the contrary, with a conventional jack, the packing ring of the piston would sustain damage each time the piston passes in front of the through-bores and would accordingly undergo rapid destruction.

The proximity detector can advantageously consist of an inductive transducer provided with a microswitch and designed for operation in a high-pressure environment, of the type marketed by Honeywell Control Systems Ltd under the series designations 921, 922, 926 and capable of operating under a pressure of 500 bar.

It would be possible to employ other types of detector such as, for example, capacitive transducers or even mechanical transducers.

The advantage of the detection system in accordance with the invention lies in the fact that it is directly integrated with the jack itself and does not entail the need for any in situ assembly or connection other than connection of the output cables of the detectors to the control apparatus.

The integration just referred-to is an important feature since it is becoming an increasingly common practice in modern technology to construct complete assemblies which are mounted and adjusted at works.

The invention not only makes it possible in circuit-breaker control systems to dispense with the conventional image jack which is subject to the disadvantages mentioned earlier but also permits accurate control of performances of circuit-breakers when these latter are put into service and thereafter at periodic intervals.

It is readily apparent that, by means of its control unit 46, the detection system in accordance with the invention indicates the open or closed position of the circuit-breaker, carries out safety interlocks with the other types of apparatus associated with the circuit-breaker (such as isolating switches, for example) and prevents such phenomena as "hunting" of the circuit-breaker in the event of tripping on closing (closing on short-circuit) if the closing order is maintained.

Furthermore, the system in accordance with the invention makes it possible to perform various measurements which were not possible either with an image jack as has been seen in the foregoing or even with mechanical linkage systems connected directly to the moving element which is actuated by the jack. In fact, by reason of the length and play of these mechanical linkage systems, the measurements were wholly inaccurate if only as a result of the strains and elastic deformations which appear in these mechanical linkages during operations of the circuit-breakers which are very abrupt.

Thus the detection system in accordance with the invention now makes it possible to carry out accurate measurement and recording of the time-delay required for withdrawal of the moving contact from the stationary contact after emission of the tripping order, to determine the curve of velocity of the moving contact (which is very important in particular in the case of self-blowing out circuit-breakers of the SF 6 type) and to check correct performance of end-of-travel damping movements.

What is claimed is:

1. A differential hydraulic jack, for controlling high-voltage electric circuit breakers, comprising:

a jack cylinder with an internal surface; a jack piston free of any packing means forming a seal with said internal surface of said jack cylinder; said piston having a range of travel, said cylinder wall having a plurality of through-bores extending in spaced relationship over a distance corresponding to said range of travel of said piston; a displacement detector with a sensitive detection element housed within each of said through-bores, said sensitive detection element being directed toward the interior of said cylinder for becoming influenced by passage of said piston opposite to the respective through-bore; sealing means between each detector and said cylinder wall for providing leak-tightness of said cylinder at high pressure within said cylinder; each said detector having output leads connected to an equipment unit for checking the position of said piston within said cylinder; said jack piston having a substantially cylindrical surface facing closely said internal surface of said jack cylinder, said jack piston being free from forming a tight seal with said internal surface of said jack cylinder, and valve means forming a seal at the end of travel of said piston.

2. A differential hydraulic jack as defined in claim 1, wherein said detector comprises a proximity detector out of physical contact with said piston when said piston passes in front of the respective through-bore.

3. A differential hydraulic jack as defined in claim 2, wherein said proximity detector comprises an inductive transducer having resistance to high hydraulic fluid pressures of the order of 300 to 400 bar.

4. A differential hydraulic jack as defined in claim 1, wherein said cylinder has generator-lines, said through-bores being pierced on one and the same one of said generator-lines.

5. A differential hydraulic jack as defined in claim 1, wherein said cylinder has a plurality of generator-lines, said through-bores being pierced on said plurality of generator-lines.

6. A differential hydraulic jack as defined in claim 1, wherein said cylinder comprises a casting.

7. A differential hydraulic jack, for controlling high-voltage electric circuit breakers, comprising: a jack cylinder with an internal surface; a jack piston free of any packing means forming a seal with said internal surface of said jack cylinder; said piston having a range of travel, said cylinder wall having a plurality of through-bores extending in spaced relationship over a distance corresponding to said range of travel of said piston; a displacement detector with a sensitive detector element housed within each of said through-bores, said sensitive detection element being directed toward the interior of said cylinder for becoming influenced by passage of said piston opposite to the respective through-bore; sealing means between each detector and said cylinder wall for providing leak-tightness of said cylinder at high pressure within said cylinder; each said detector having output leads connected to an equipment unit for checking the position of said piston within said cylinder; said detector comprising a proximity detector out of physical contact with said piston as said piston passes in front of the respective through-bore; said proximity detector being an inductive transducer having resistance to high hydraulic fluid pressures of the order of 300 to 400 bar; said cylinder having generator-lines, said through-bores being pierced on one and the same generator-lines; said cylinder comprising a casting; said jack piston having a substantially cylindrical surface facing closely said internal surface of said jack cylinder, said jack piston being free from forming a tight seal with said internal surface of said jack cylinder, and valve means forming a seal at the end of travel of said piston.

* * * * *